US006634200B2

(12) United States Patent
Kleiner et al.

(10) Patent No.: US 6,634,200 B2
(45) Date of Patent: Oct. 21, 2003

(54) METHOD AND DEVICE FOR PRODUCING CURVED EXTRUDED PROFILES

(75) Inventors: Matthias Kleiner, Wickede (DE); Dieter Arendes, Hildesheim (DE); Alexander Klaus, Wuppertal (DE)

(73) Assignee: WKW Erbsloeh Automotive GmbH, Velbert (DE)

( * ) Notice: Subject to any disclaimer, the term of this patent is extended or adjusted under 35 U.S.C. 154(b) by 0 days.

(21) Appl. No.: 09/958,492

(22) PCT Filed: Feb. 9, 2001

(86) PCT No.: PCT/EP01/01415

§ 371 (c)(1),
(2), (4) Date: Nov. 6, 2001

(87) PCT Pub. No.: WO01/58613

PCT Pub. Date: Aug. 16, 2001

(65) Prior Publication Data

US 2003/0094028 A1 May 22, 2003

(30) Foreign Application Priority Data

Feb. 10, 2000 (DE) ..... 100 05 903

(51) Int. Cl.[7] ..... B21C 23/00
(52) U.S. Cl. ..... 72/260; 72/257; 72/260
(58) Field of Search ..... 72/256, 257, 200, 72/253.1; 264/295, 339

(56) References Cited

U.S. PATENT DOCUMENTS 1,789,675 A * 1/1931 Elias ..... 72/377
2,738,873 A * 3/1956 Emmerich ..... 72/268
4,352,281 A * 10/1982 Ragettli ..... 72/131
4,906,171 A * 3/1990 Miller ..... 425/131.1
5,305,626 A * 4/1994 Tiekink ..... 72/257
5,520,870 A * 5/1996 Allan et al. ..... 264/210.2
6,190,595 B1 * 2/2001 Thoms et al. ..... 264/177.16

FOREIGN PATENT DOCUMENTS

| | | |
|---|---|---|
| JP | 56041013 | 4/1981 |
| JP | 58184012 | 10/1983 |
| JP | 20011039 | 1/2001 |

* cited by examiner

*Primary Examiner*—Allen Ostrager
*Assistant Examiner*—John S. Goetz
(74) *Attorney, Agent, or Firm*—Jordan and Hamburg LLP

(57) ABSTRACT

In a method for producing curved work pieces, an extruded profile leaves the die of an extruder in the strand discharge direction and is then bent into a curved shape by external forces. The extruded profile that leaves the die, before being bent, is deflected so that the strand discharge direction extends forwards at an angle counter to the eventual curvature of the work piece. To this end, the die comprises a tool holder in whose receiving opening an extrusion tool package consisting of a die with or without a mandrel and a cover part is disposed. The guide surfaces of the die and/or of the mandrel that produce the discharged strand are designed or disposed to be at an angle with respect to the strand discharge direction which extends at an incline with respect to the center axis of the die counter to the eventual curvature of the work piece.

20 Claims, 2 Drawing Sheets

METHOD AND DEVICE FOR PRODUCING CURVED EXTRUDED PROFILES

The invention relates to a method and to an apparatus for producing curved workpieces, the workpiece being shaped in the female die of an extrusion press and leaving the latter in the outlet direction of extrudate.

Curved aluminum profiles are used in different areas of technology, especially in the construction of vehicles running on rails or streets and of aircraft. Conventionally, these workpieces are manufactured by straight extrusion presses with subsequent stretching and bending.

In accordance with a further development of this method, the desired final contour is produced by bending practically simultaneously with the extrusion pressing (EP 0706843 A1). For this purpose, conventional extrusion presses are used, a crosshead usually being employed as a pressure pad with a small opening for supporting the female die.

If the extrusion-molded profile is to be rounded during the bending near the compression mold, the geometry of the press outlets limits the minimum radius, which can be produced. Otherwise, there would be a collision between the extrudate and the press. As a result, the possible product diversity is greatly limited It is an object of the present invention to make even tighter radii of extruded products possible at little expense and, with that, to expand the spectrum of products, which can be manufactured.

This objective is accomplished by an inventive method owing to the fact that the extruded profile, as it leaves of the female die and before it is bent, is deflected in such a manner, that the outlet direction (A) of the extrudate extends obliquely towards the front, counter to the later curvature of the workpiece. The extrudate, initially emerging from the compression mold obliquely, is aligned so that, due to a subsequent bending towards the other side, it can experience a significantly greater curvature.

In the case of an inventive extrusion molding apparatus for producing curved workpieces with a die holder, in the accommodating opening of which a compression mold package, consisting of a female die with or without a mandrel and a covering part, is disposed, provisions are made so that the guiding surfaces, producing the emerging extrudate, are formed or disposed obliquely by the female die and/or the mandrel corresponding to the extrudate outlet direction, and so that the outlet direction of the extrudate extends at an angle of incidence to the center axis of the female die, counter to the later curvature of the workpiece.

Alternatively, the change in the outlet direction of the extrudate is achieved by

- the inclination of the guiding surfaces of the female die and optionally of the mandrel,
- the incorporation of a conventional compression mold in a modified die holder and/or by
- the incorporation of an oblique, flattened compression mold in a conventional die holder.

In the following, a conventional compression mold package is described (FIG. 1) and the invention is explained in greater detail by means of several examples. FIGS. 2–4 show sections of different, possible, alternative solutions to the problem of producing curved extrusion-molded profiles:

Figure 1:
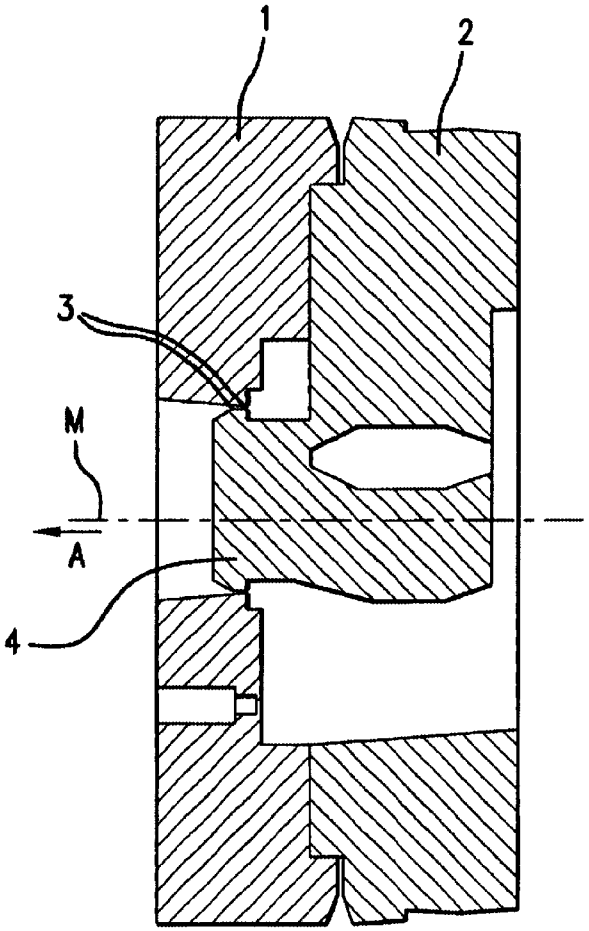
FIG. 1 PRIOR ART
FIG. 1 shows a conventional compression mold of the state of the art.

The conventional compression mold package consists of a female die 1, a mandrel part 2 with mandrel 4 and guiding surfaces 3 on either side between the mandrel 4 and the female die 1. The outlet direction of the extrusion-molded profiles, which coincides with the center axis M of the female die in the conventional extrusion press (FIG. 1), is indicated by arrow A.

Figure 2:
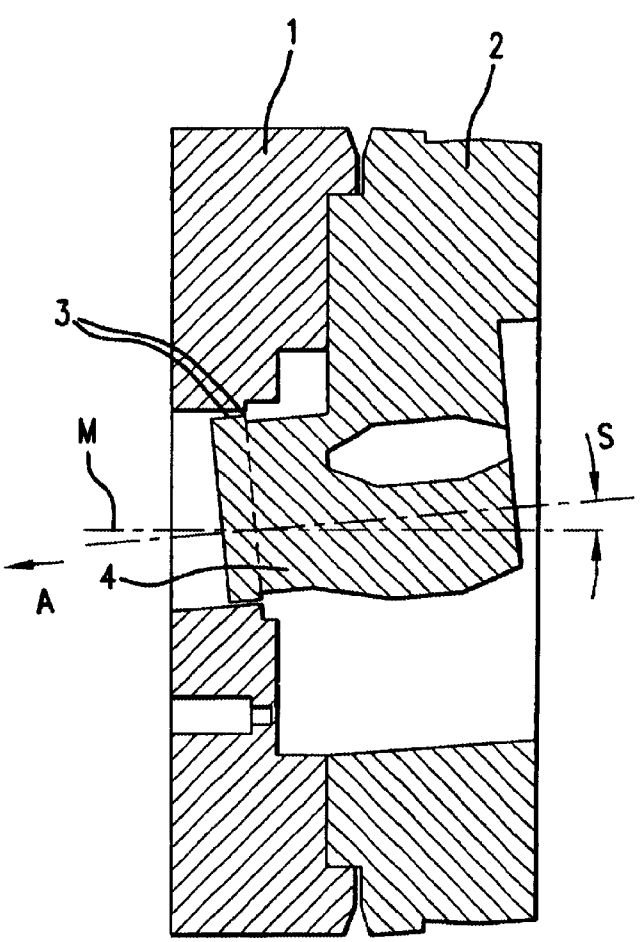
FIG. 2 shows a compression device, constructed pursuant to the invention, with oblique guiding surfaces and an obliquely disposed mandrel.

The basic idea of the present invention, namely to position the outlet direction A of the extrudate counter to the later curvature of the workpiece and inclined at an angle of incidence S to the center line M, can be achieved in various ways. In the cross-section of FIG. 2, the guiding surfaces 3 from the female die 1 and the mandrel 4 are inclined with respect to the center axis M of the female die 1. The arrow A in FIG. 2 therefore indicates the desired inclined outlet direction of the extrudate, which extends counter to the later curvature of the workpiece W (line of dots in FIG. 3). The inclined guiding surface 3 can be realized on the mandrel side by appropriately machining or inclining the mandrel 4.

Figure 3:
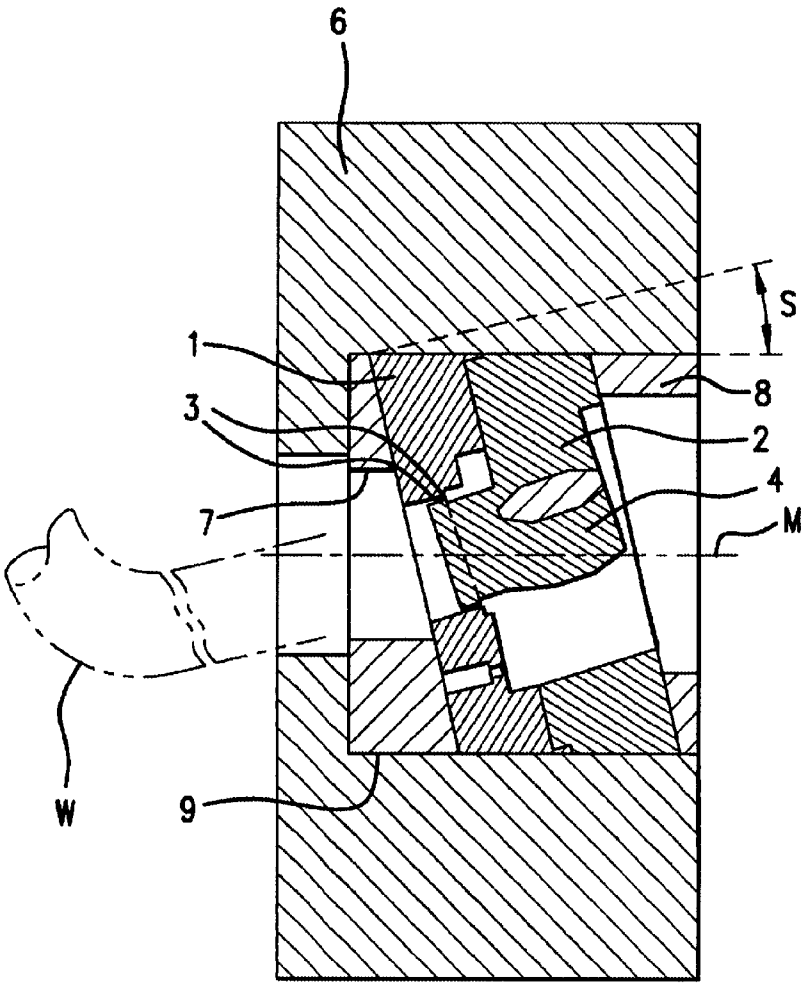
FIG. 3 shows a compression device, constructed pursuant to the invention, with an oblique compression mold in a conventional die holder

A further, possible, alternative solution to the problem of producing curved, inventive extrusion-molded profiles is shown in FIG. 3. A modified compression mold, consisting of a female die 1 and a mandrel part 2, is shown here in a conventional die holder 6. The modification consists therein that the periphery of the compression mold has flattenings, which correspond to the angle of incidence S, so that, in conjunction with a wedge-shaped backing 7, it can be inserted at an angle in the opening 9, which accommodates the die holder 6. Of course, an appropriately beveled covering part 8 is also inserted in the opening 9 for supporting the mandrel part 2, so that the forces, acting on the compression mold, can be taken up in the die holder 6.

Figure 4:
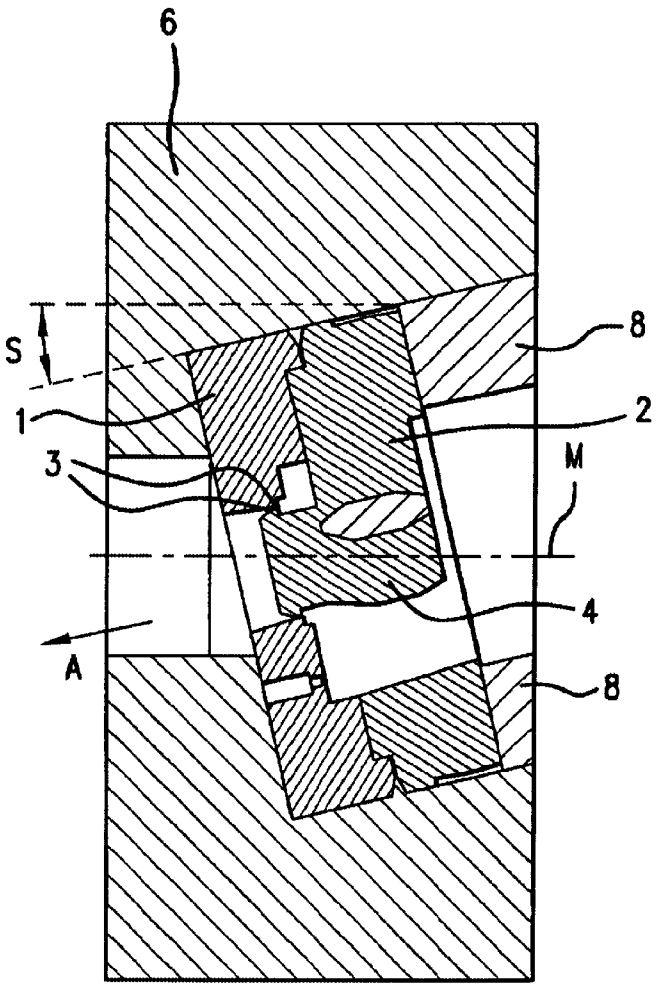
FIG. 4 shows a compression device, constructed pursuant to the invention, with an obliquely constructed die holder and a conventional compression mold.

The variation of the basic inventive concept, shown in FIG. 4, shows a pressing device with a seating opening 9, which is incorporated at an angle in the die holder 6 and in which a conventional compression mold is inserted. This is held by a conventional covering part 8, which presses the female die 1 and the mandrel part 2 against the front end of the seating opening 9, which extends obliquely in the die holder 6. If appropriate, combinations of the alternatives, described above, can also be selected, in which, for example, oblique guiding surfaces 3 can be combined with a compression mold, which is inserted obliquely at the angle of incidence S, or beveled peripheral sides of the female die 1 or of the mandrel part 2 can be combined with an obliquely extending seating opening 9. In this connection, it should always be taken into consideration that the outlet direction A of the extrudate extends obliquely and counter to the later curvature of the workpiece.

What is claimed is:

1. A method for producing curved workpieces, comprising the steps of:

providing a die holder having a center axis;

providing a female die having an outlet opening, the center axis of the die holder extending through the outlet opening;

removing a workpiece from the female die through the outlet opening in an outlet direction which is at an oblique angle to and in a first direction from the center axis of the die holder; and then bending the workpiece only after being removed from the female die in a second direction relative to the center axis of the die holder which is opposite to the first direction.

2. The method of claim 1, wherein the step of removing the workpiece from the female die in the outlet direction which is at an oblique angle to the center axis of the die holder comprises the step of providing the female die with guiding surfaces defining the outlet opening and which are inclined with respect to the center axis of the die holder such that the center axis of the die holder coincides with a center axis of the female die.

3. The method of claim 2, wherein the step of removing the workpiece from the female die in the outlet direction which is at an oblique angle to the center axis of the die holder further comprises the steps of arranging a mandrel behind the female die and providing the mandrel with guiding surfaces inclined with respect to the center axis of the die holder.

4. The method of claim 1, wherein the step of removing the workpiece from the female die in the outlet direction which is at an oblique angle to the center axis of the die holder comprises the steps of arranging a mandrel behind the female die and providing the mandrel with guiding surfaces inclined with respect to the center axis of the die holder.

5. The method of claim 1, further comprising the step of positioning the female die in a seating opening of the die holder.

6. The method of claim 5, further comprising the steps of:

inserting the female die into the seating opening of the die holder at an oblique angle which is substantially the same as the angle between the outlet direction and the center axis of the die holder; and arranging a wedge-shaped member in the seating opening of the die holder between the outlet opening and the female die.

7. The method of claim 1, wherein the step of removing the workpiece from the female die in the outlet direction which is at an oblique angle to the center axis of the die holder comprises the steps of arranging a mandrel behind the female die, further comprising the step of positioning the female die and mandrel in a seating opening of the die holder.

8. The method of claim 7, further comprising the steps of:

inserting the female die and mandrel into the seating opening of the die holder at an oblique angle which is substantially the same as the angle between the outlet direction and the center axis of the die holder;

arranging a wedge-shaped member in the seating opening of the die holder between the outlet opening and the female die; and arranging a covering part behind the mandrel for supporting the mandrel.

9. The method of claim 1, further comprising the step of positioning the female die in a seating opening in the die holder arranged such that a surface defining a front of the seating opening is at an oblique angle to a front face of the die holder.

10. The method of claim 1, wherein the step of removing the workpiece from the female die in the outlet direction which is at an oblique angle to the center axis of the die holder comprises the steps of arranging a mandrel behind the female die, further comprising the step of positioning the female die and mandrel in a seating opening in a die holder arranged such that a surface defining a front of the seating opening is at an oblique angle to a front face of the die holder.

11. The method of claim 10, further comprising the step of:

arranging a covering part behind the mandrel for supporting the mandrel.

12. An extrusion-molding device for producing curved workpieces, comprising:

a die holder having a center axis and a seating opening; and a compression mold unit arranged in said seating opening, said compression mold unit comprising a female die having an outlet opening, said center axis of said die holder extending through said outlet opening, and guiding surfaces defining said outlet opening and inclined with respect to the center axis of said die holder such that the workpiece is removed from said female die through said outlet opening in an outlet direction which is, at said outlet opening, at an oblique angle to and in a first direction from the center axis of said die holder.

13. The device of claim 12, wherein the workpiece is bent only after being removed from said female die in a second direction relative to the center axis of said die holder which is opposite to the first direction.

14. The device of claim 12, wherein said compression mold unit further comprises a mandrel arranged behind said female die and including guiding surfaces inclined with respect to the center axis of said die holder.

15. The device of claim 14, further comprising a covering part arranged behind said mandrel for supporting said mandrel.

16. The device of claim 12, wherein said female die is arranged in said seating opening of said die holder at an oblique angle which is substantially the same as the angle between the outlet direction and the center axis of said die holder.

17. The device of claim 16, further comprising a wedge-shaped member arranged in said seating opening of said die holder between said outlet opening and said female die.

18. The device of claim 16, wherein a periphery of said compression mold unit is beveled at an angle substantially the same as the angle between the outlet direction and the center axis of said die holder.

19. The device of claim 12, wherein said seating opening is formed in said die holder such that a surface defining a front of said seating opening is at an oblique angle to a front face of said die holder.

20. The device of claim 12, wherein said seating opening is inclined at an angle which is substantially the same as the angle between the outlet direction and the center axis of said die holder.

* * * * *